US009587301B2

(12) United States Patent
Mendibide

(10) Patent No.: US 9,587,301 B2
(45) Date of Patent: Mar. 7, 2017

(54) STEEL FOR MANUFACTURING CEMENTED STEEL PARTS, CEMENTED STEEL PARTS MADE WITH SAID STEEL AND METHOD FOR MANUFACTURING SAME

(75) Inventor: Christophe Mendibide, Pagny sur Moselle (FR)

(73) Assignee: Asco Industries, Hagondange (FR)

( * ) Notice: Subject to any disclaimer, the term of this patent is extended or adjusted under 35 U.S.C. 154(b) by 378 days.

(21) Appl. No.: 14/237,686

(22) PCT Filed: Aug. 8, 2012

(86) PCT No.: PCT/EP2012/065523

§ 371 (c)(1),
(2), (4) Date: Apr. 8, 2014

(87) PCT Pub. No.: WO2013/021009

PCT Pub. Date: Feb. 14, 2013

(65) Prior Publication Data

US 2014/0224383 A1 Aug. 14, 2014

(30) Foreign Application Priority Data

Aug. 9, 2011 (FR) ..... 11 57254

(51) Int. Cl.

| | |
|---|---|
| ***C23C 8/22*** | (2006.01) |
| ***C23C 8/66*** | (2006.01) |
| ***C23C 8/02*** | (2006.01) |
| ***C23C 8/80*** | (2006.01) |
| ***C21D 1/06*** | (2006.01) |
| ***E21B 10/46*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |
| ***C22C 38/58*** | (2006.01) |
| ***C22C 38/60*** | (2006.01) |
| ***C23C 8/04*** | (2006.01) |

(52) U.S. Cl.

CPC ..... *C23C 8/66* (2013.01); *C21D 1/06* (2013.01); *C21D 6/002* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C22C 38/58* (2013.01); *C22C 38/60* (2013.01); *C23C 8/02* (2013.01); *C23C 8/04* (2013.01); *C23C 8/22* (2013.01); *C23C 8/80* (2013.01); *E21B 10/46* (2013.01); *C21D 2241/00* (2013.01)

(58) Field of Classification Search

CPC .... C23C 8/22; C23C 8/32; C23C 8/66; C23C 8/02; C23C 8/80

See application file for complete search history.

(56) References Cited

U.S. PATENT DOCUMENTS 6,258,179 B1 * 7/2001 Takayama ..... C23C 8/80 148/216

FOREIGN PATENT DOCUMENTS

| | | | | |
|---|---|---|---|---|
| DE | 102 43 179 A1 | | 4/2004 | |
| EP | 1 277 847 A1 | | 1/2003 | |
| EP | 1 342 800 A1 | | 9/2003 | |
| JP | 2003-328079 | * | 11/2003 | ..... C22C 38/00 |
| JP | 2011-052307 | * | 3/2011 | ..... C21D 8/02 |
| WO | WO 03/062484 A1 | | 7/2003 | |

OTHER PUBLICATIONS

Englsih Abstract and English Machine Translation of Okubo et al. (JP 2011-052307) (Mar. 17, 2011).*

English Abstract and English Machine Translation of Sakamoto et al. (JP 2003-328079) (Nov. 19, 2003).*

ASM International, Materials Park, Ohio, ASM Handbook vol. 4: Heat Treating, Introduction to Surface Hardening of Steels, pp. 259-267, Aug. 1991.*

International Search Report in International Application No. PCT/EP2012/065523.

* cited by examiner

*Primary Examiner* — Jessee Roe

(74) *Attorney, Agent, or Firm* — Eric L. Lane; Green Patent Law

(57) ABSTRACT

Steel for manufacturing cemented steel parts, characterized in that the composition thereof in weight percentages is:

0.1%≤C≤0.15%;
0.8%≤Mn≤2%;
1%≤Cr≤2.5;
0.2%≤Mo≤0.6%;
trace elements≤Si≤0.35%;
trace elements≤Ni≤0.7%;
trace elements≤B≤0.005%;
trace elements≤Ti≤0.1%;
trace elements≤N≤0.01% if 0.0005%(5ppm)≤B≤0.005%, and trace elements≤N≤0.02% if trace elements≤B≤0.0005%(5ppm);
trace elements≤Al≤0.1%;
trace elements≤V≤0.3%;
trace elements≤P≤0.025%;
trace elements≤Cu≤1%, preferably≤0.6%;
trace elements≤S≤0.1%;

the remainder being iron and impurities resulting from production.

A cemented steel part made with this steel, and to the method for manufacturing same.

1 Claim, No Drawings

STEEL FOR MANUFACTURING CEMENTED STEEL PARTS, CEMENTED STEEL PARTS MADE WITH SAID STEEL AND METHOD FOR MANUFACTURING SAME

The invention relates to steel metallurgy, and more particularly to cemented steel grades having high resilience.

One of the main applications of such steels is the manufacturing of mechanical parts with a large format and more particularly the manufacturing of drill bits.

Such a bit is a forged tool consisting of three rotary steel cones « entangled» in each other and allowing the breaking-up of geological formations during oil or gas exploration operations. These three cones rotate via one or several bearings, on three steel arms assembled by welding. The rolling tracks machined on the arms and inside the cones are generally, in conventional production methods, surface-treated by atmospheric cementation in order to reach a conventional depth, where the Vickers hardness is 550 HV, on average comprised between 1 and 1.5 mm.

The present invention relates to a new grade of steel which may be used for making cones and arms. There exist several kinds of such bits. One of them is the drill bit with « inserted teeth» i.e. in which pins, most often in tungsten carbide obtained by powder metallurgy, are crimped in each of the cones. The steel object of the present invention is not limited in its use to this type of drill bit, but may also be used for producing bits with « machined teeth» .

Presently the reference grades used for the manufacturing of cones and arms forming the bits are steels highly alloyed with nickel at contents which may attain 3.5% by weight (notably the grade of type 15NiCrMo13). This alloy element is usually considered as required for imparting to the product the ductility level indispensable for withstanding the severity of the mechanical stresses to which it is subject when operating. This ductility should be associated with tensile characteristics and with high hardenability. The typically sought properties for these grades are actually:

- hardenability such that the Jominy curve is typically horizontal at least over a depth of 20 mm; as described in document FR-A-2 765 890, this characteristic may be evaluated by the coefficient β corresponding to the hardness difference between the Jominy points $J_{15}$ and $J_3$. In order that hardenability be sufficient, the Jominy curve should verify β<3.5 HRC and $J_1$>40 HRC; it is recalled that the Jominy curve is a curve which expresses the hardenability of a steel; it is obtained by means of a standardized test (notably by the NF EN ISO 642 standard) by measuring the hardness along a generatrix of a cylindrical specimen hardened with a water jet spraying one of its ends; the hardness measured at a depth of x mm from said end is designated by $J_x$;
- an elasticity limit Re of more than 900 MPa;
- a tensile strength Rm greater than 1,200 MPa;
- a resilience Kv measured at 20° C. greater than 75 J;
- good capability for atmospheric cementation; it is notably expressed by the possibility of finding atmospheric cementation conditions with which it is possible to attain the following characteristics:
  - a cementation depth at 550 HV comprised between 1.2 and 1.5 mm;
  - a surface hardness of more than 670 HV;
  - an austenitic grain size such that the grain index is greater than ASTM 5;
  - a maximum surface bulk content of residual austenite (at 20 μm under the skin of the metal) in the cemented layer, of less than a content of the order of 40%, such as typically sought after treatment of cemented grades of the 15NiCrMo13 type.

However, the steels usually used in this context have, as this has been said, a Ni content requiring a significant addition of this expensive element and for which the purchase price is highly variable over time. An attempt was therefore made for replacing these steels with cemented steels without any Ni, having improved resilience.

Document U.S. Pat. No. 6,146,472 shows an example of this. The increase in the resilience y is obtained by controlling the resistance to enlargement of the austenitic grain via the use of a micro-alloy Nb—Al—N, associated with an optimized heat treatment. However, the values of resiliencies indicated in this document are at best close to 60 J, and the examples shown are castings which do not give the possibility of meeting the hardenability criterion β<3.5 HRC.

Also, document US-A-2005/0081962 describes a steel for cementation not using any Ni, but for which the resilience does not exceed 51 J, which is not sufficient.

The object of the invention is to propose a cemented steel which may notably be used for manufacturing drill bits, not requiring any addition of Ni and nevertheless meeting all the criteria of ductility, hardenability, Re, Rm and Kv mentioned above.

For this purpose, the object of the invention is a steel for the manufacturing of cemented steel parts, characterized in that its composition, in weight percentages, is:

- 0.1%≤C≤0.15%;
- 0.8%≤Mn≤2%;
- 1%≤Cr≤2.5%;
- 0.2%≤Mo≤0.6%;
- trace elements≤Si≤0.35%;
- trace elements≤Ni≤0.7%, preferably trace elements≤Ni≤0.3%;
- trace elements≤B≤0.005%;
- trace elements≤Ti≤0.1%, preferably trace elements≤Ti≤0.04%;
- trace elements≤N≤0.01% if 0.0005%<B≤0.005%, and trace elements≤N≤0.02% if trace elements≤B≤0.0005%;
- trace elements≤Al≤0.1%;
- trace elements≤V≤0.3%;
- trace elements≤P≤0.025%;
- trace elements≤S≤0.1%;
- trace elements≤Cu≤1%, preferably≤0.6%;

the remainder being iron and impurities resulting from production.

Preferably, trace elements≤O≤30 ppm.

The object of the invention is also a cemented steel part, characterized in that it is in a steel having the previous composition and in that it has undergone cementation.

This may be a drill bit.

The object of the invention is also a method for manufacturing a cemented steel part, characterized in that:

- a blank of said part is prepared in a steel having the previous composition. This shaping may be carried out by any method (forging, machining, or hot rolling . . . );
- and cementation is performed on said blank.

In the case of an atmospheric cementation method, the succession of steps may be the following:

- heating up to the enrichment level temperature.
- enrichment level at a temperature from 900 to 980° C. for 3 to 20 hrs and at a carbon potential comprised between 0.8 and 1.2%;

diffusion at a temperature of 820 to 880° C. at a carbon potential comprised between 0.6 and 0.8%, with a treatment time from 1 to 4 hrs;

quenching in oil at a temperature of less than or equal to 160° C.

tempering at a temperature comprised between 150 and 250° C. and for a period comprised between 1 and 4 hrs.

In the case when cementation is carried out at a low pressure, said pressure may be from 5 to 20 mbars, and the succession of steps of the cementation may be the following:

heating up to the temperature of the enrichment level.

enrichment level at a temperature from 900 to 980° C. for 3 to 20 hrs and at a carbon potential comprised between 0.8 and 1.2%;

diffusion at a temperature from 890 to 950° C. at a carbon potential comprised between 0.6 and 0.8%, with a treatment period from 1 to 4 hrs;

quenching at a temperature of less than or equal to 160° C.

tempering at a temperature comprised between 150 and 250° C. and for a period comprised between 1 and 4 hrs.

As this will have been understood, the invention is based on careful adjustment of the composition of the steel, giving the possibility of meeting all the criteria mentioned above.

Further the steel, object of the present invention, is also different from the one described in U.S. Pat. No. 6,146,472 in that the accessible resiliencies are significantly higher and in that the improvement of the resilience is not at least mainly generated by controlling grain size. This has the advantage of not modifying the capability of the grade for thermomechanical treatment and of limiting the risk of an abnormal enlargement of the austenitic grain during cementation. The segregating effect of niobium which risks leading to a heterogeneous austenitic grain size, is notably avoided. The resilience level accessible through the present invention is also significantly higher.

The type of cementation which may be used with the steel described in the present invention is not limited to the atmospheric cementation method which may be replaced with other surface hardening methods, for example low pressure cementation.

The present invention is based on a steel for which the composition is defined below. All the contents are given in weight percentages. By using a composition defined as described hereafter, it is possible to produce, without any voluntary addition of nickel and without using substantial amounts of other costly elements, a steel having hardenability, mechanical characteristics after hardening followed by tempering and cementation capability (absorption of carbon, core resilience, cementation depth, residual austenite content . . . ) close to those of the reference grades with 3.5% of Ni usually used for manufacturing drill bits.

The C content is comprised between 0.10% and 0.15% i.e. a carbon content limited to a relatively narrow range, and which is small as compared with those generally encountered in cemented steels. This low carbon content gives the possibility of obtaining very high resiliencies in the core of cemented steel parts. The loss of hardenability and the decrease in the core hardness of the products after cementation which would normally result from this lowering of the C content, are compensated by optimized adjustment of the concentration of the other alloy elements.

The Mn content is comprised between 0.8% and 2%. Manganese is used with chromium and molybdenum for compensating the loss of hardenability associated with the reduction of the carbon content. In order that its effect be sufficient, a content greater than or equal to 0.8% is required. As this alloy element may pose segregation problems, it is preferable that its concentration not exceed 2%.

The Cr content is comprised between 1% and 2.5%. Like manganese, chromium is used for ensuring a sufficient hardenability level for the grade. The minimum 1% content is selected so that the effect of this alloy element on the hardenability is sufficient. The maximum 2.5% content is defined so as to avoid a detrimental effect on the properties of use, notably by forming coarse chromium carbides.

The Mo content is comprised between 0.2% and 0.6%. Molybdenum is a third element used for adjusting the hardenability of the grade. This is also an alloy element which may be suitably used for increasing resilience, notably at low temperature. With molybdenum, it is also possible to exacerbate the effect of boron on hardenability, and may therefore be used for this purpose in the case of a grade alloyed with boron. For a content of less than 0.2%, the increase in the hardenability is too small and this value is therefore selected as a minimum value. For strong concentrations, the molybdenum tends to reduce the forgeability of the steels. Further, as this is an expensive alloy element, its use at an excessive content would lead to a loss of the economic benefit brought by not using nickel. For these reasons, a maximum content of 0.6% is preferred.

The Si content is less than 0.35%. Just like aluminum, silicon may be used as a deoxidization element. For a steel which has been deoxidized by adding silicon, the residual content of this element in any case does not generally exceed 0.35%. A content of 0.35% should also not be exceeded in the steels of the invention, since silicon is an alloy element which may limit, by a barrier effect, the absorption of carbon during cementation.

The Ni content is less than or equal to 0.7%, preferably 0.3%. As this has been stated, one of the objects of the present invention is to give the possibility of doing without a voluntary addition of this element. However, it is still present in the residual state in the raw materials used for producing the steel, notably in scrap iron. The 0.3% content corresponds to the maximum content most generally encountered when no voluntary addition of nickel is carried out during production.

The B content is less than 0.005%. Boron is an optional element. It may be used for optimally adjusting the hardenability of the grade if the Mn, Cr and Mo contents are not quite sufficient for this purpose. But in order that this alloy element actually act on hardenability, it should be maintained in a solid solution. For this, precipitation of boron nitrides or oxides should be avoided. This result may be obtained by adding an alloy element with stronger affinity for nitrogen, for example titanium, and by controlling the production method for limiting the dissolution of nitrogen and oxygen in the steel.

The Ti content is less than 0.1% and preferably less than 0.04%. Titanium is optionally added for allowing the boron to be maintained in a solid solution by precipitation of titanium nitrides which reduce the amount of nitrogen which would be capable of combining with boron. Its content should optimally be selected depending on the amount of nitrogen of the grade. In order to be totally efficient, a stoichiometric amount of titanium should be added in order to ensure precipitation of the totality of the nitrogen contained in the steel in the form of TiN, and thus maintain the boron in a solid solution. This is verified if the Ti/N ratio is greater than 3.4. In the case of a sub-stoichiometric addition of titanium, the effect of boron on the hardenability may nevertheless be expressed but is less marked. Beyond the prescribed limit, there is a risk of forming too coarse TiN during solidification, and further the addition of Ti becomes excessively expensive.

The N content is less than 0.02%, preferably less than 0.01%. In the case of a production with addition of boron and titanium, it is necessary to control the nitrogen content of the steel in order to limit the risk of formation of coarse titanium nitride TiN, which may deteriorate the properties of use of the product. In the case of boron addition (from 5 to 50 ppm), a nitrogen content of less than 0.01% is therefore recommended. If boron is not used (B<5ppm), it is not absolutely indispensable to strictly control the nitrogen content which may then range up to 0.02% without any detrimental effect on the properties of the produced steel.

The Al content should be at most 0.1%: aluminum is an optional element. It may be used as a deoxidizer of steel as a replacement for silicon, and for optimizing the strength of the austenitic grain during cementation.

The V content is at most 0.3%. Vanadium is an optional element. It may be used as a micro-alloy element for better controlling the grain size during cementation, providing additional improvement of resilience.

The P content is at most 0.025%. This limit is recommended in order not to risk embrittlement of the steel. At a too high content, this element actually tends to segregate at the austenitic grain boundaries, which may lead to an increase in the ductile-brittle transition temperature and to lowering of resilience at room temperature.

The Cu content is at most 1%, preferably at most 0.6%. A maximum content of 1% is recommended since this is an expensive element which does not provide any hardenability or resilience benefit. The preferred maximum value of 0.6% is a content usually recognized as being the one below which copper has no notable effect on the mechanical properties of the steel. Nevertheless its use at a higher content may be contemplated without modifying the capability of the grade of being used for manufacturing drill bits.

The negative effects of the copper at lower content are in particular the risk of surface defects appearing during rolling (crazing). Additions of Ni and/or Si may provide a remedy for this, but as the invention requires relatively low contents of these elements, they cannot be counted on for limiting the detrimental effects of copper, whence the limits of 1%, better 0.6%, for the copper content of the steels of the invention.

The S content is not strictly imposed in the most general definition of the steel according to the invention, but it should be controlled depending on the contemplated application. A low content will be sought if it is desired to improve the inclusion cleanliness by not forming any sulfide (significantly<0.01%) and a higher content may be selected (typically from 0.03% to 0.1%) if a gain in machinability is sought and subject to that the inclusion cleanliness remains compliant with the requirements needed by the contemplated application for the steel.

The O content is most often at most 0.003% (30 ppm), so as to optimize the inclusion cleanliness. This limit may possibly be exceeded if the future application of the steel does not require very good inclusion cleanliness, and in any case a determined O content is not an intrinsic property of the steel according to the invention.

Control of the oxygen content is ensured by inertization systems during casting and by controlling the content of deoxidizing elements such as Si and Al. When these deoxidizing elements are present at low contents, it is nevertheless possible to ensure low oxygen content in the liquid metal:

- either by stirring the liquid metal so as to place it in chemical equilibrium with the slag, the composition of which is under control so that this chemical equilibrium leads to establishing a low content of dissolved oxygen in the liquid metal, and next by avoiding re-oxidization of the liquid metal until casting by efficient protection against atmospheric oxygen, for example inertization of the surface of the metal with argon, and confinement of the pouring streams in refractory tubes themselves filled with argon;
- or by conducting the production of the liquid metal at least partly under reduced pressure, so that the dissolved oxygen content is limited by the carbon present in the liquid steel, which causes departure of the excess dissolved oxygen in the form of CO; subsequently, like in the previous case, the low dissolved oxygen content should be retained until casting by efficient protection of the liquid steel against atmospheric re-oxidizations.

For the other elements, they may be present in the condition of simple impurities resulting from production.

In the case of an atmospheric cementation method aiming at obtaining a surface carbon content from 0.5 to 0.8% typically, the succession of steps may be the following:

- heating up to the temperature of the enrichment level; a rate of the order of 10° C./min for this heating is recommended for providing good control in the development of the size of the grains;
- an enrichment level at a temperature below 900 to 980° C. and at a carbon potential comprised between 0.8 and 1.2, for a period from 3 to 20 hrs; these conditions may vary depending on the exact composition of the treated steel, and especially on the targeted cementation depth; typically for a temperature of 960° C., a treatment for 3 to 6 hrs allows cementation of the part over a depth from 1 to 1.5 mm;
- diffusion at a temperature from 820 to 880° C. at a carbon potential comprised between 0.6 and 0.8%, with a treatment period from 1 to 4 hrs, typically of the order of 2 hrs; the criteria for selecting the diffusion temperature are, mainly and conventionally for one skilled in the art, related to the situation of the phase transformation points of the treated grade, and to the fact that this temperature should not be too high in order to minimize deformation to the part during the quenching which follows;
- quenching in oil at a temperature of less than or equal to 160° C.;
- tempering at a temperature comprised between 150 and 250° C. and for a period conventionally of the order of 2 hrs, in any case comprised between 1 and 4 hrs.

This type of cementation is only an example and other methods may be used. In particular, it is possible to resort to low pressure cementation in order to avoid possible problems of surface and/or intergranular oxidation during the treatment, and also for accessing greater cementation depths than the 1 to 2 mm usually accessible by atmospheric cementation and/or for reducing the cementation period by means of a high temperature at which low pressure cementation is practiced.

In the case of low pressure cementation method conducted at a pressure of a few millibars (from 5 to 20 mbars), the succession of steps may be the following, aiming a surface C content typically from 0.5 to 0.8%:

- heating up to the temperature of the enrichment level; a rate of the order of 10° C./min for this heating is recommended for providing good control of the development of the size of the grains;

an enrichment level at a temperature from 900 to 980° C. and at a carbon potential comprised between 0.8 and 1.2, for a period from 3 to 20 hrs; these conditions may vary depending on the exact composition of the treated steel, and especially on the targeted cementation depth; typically for a temperature of 960° C., a treatment for 3 to 6 hrs allows cementation of the part over a depth from 1 to 1.5 mm while avoiding surface oxidation problems which may be encountered during atmospheric cementation;

diffusion at a temperature of 890-950° C., at a carbon potential comprised between 0.6 and 0.8%, with a treatment period from 1 to 4 hrs, typically of the order of 2 hrs; the criteria for selecting the diffusion temperature are, mainly and conventionally for one skilled in the art, related to the situation of the phase transformation points of the treated grade, and to the fact that this temperature should not be too high in order to minimize deformations of the part during the quenching which follows;

quenching, for example in oil or in gas (a quenching pressure comprised between 3 and 10 bars), at a temperature of less than or equal to 160° C.;

tempering at a temperature comprised between 150 and 250° C. and conventionally for a period of the order of 2 hrs, in any case comprised between 1 and 4 hrs.

Of course, the obtained mechanical properties of the final product not only depend on the composition of the steel, but also on the heat and thermomechanical treatments which it undergoes, until the product is obtained. However it may be noted that in the case when the final product has to be cemented, the hot-forming conditions by forging, rolling or other technique, has only little importance. Indeed cementation is accompanied by a quenching and tempering operation which imparts to the product a novel structure and suppresses the consequences of the hot-forming. It is then this treatment which imparts to the product essentially its mechanical properties, it is not itself followed by any other treatment which may modify them.

The results of tests carried out on steel according to the invention and on reference steels will now be described. All the results shown were obtained on laboratory castings forged at 1,200° C. in bars with a square section with a side of 40 mm.

Before forging, the steel appears as small ingots with a square section 100×100 mm and a height of 200 mm. After forging, the bars with a section of 40×40 mm are cooled in calm air and then standardized for 2 hrs at a temperature of 875, 900 or 925° C., selected according to the transformation point Ac3 of the grade. This standardization is intended to homogenize the carbon content and the initial microstructure in the whole product.

The composition of the different tested grades is given in Table 1. The castings Nos. 1 to 4 are those for which the composition is according to the present invention. The castings Nos. 5 to 10 are those for which at least one of the alloy elements is outside the claimed intervals. All the concentrations are given in weight %, except for nitrogen, oxygen and boron which are given in ppm by weight. The Table also indicates the temperature of the transformation point Ac3 (in ° C.) of each of the grades.

TABLE 1

Compositions and Ac3 temperatures of the tested samples

| | Samp. | C % | Si % | Mn % | Ni % | Cr % | Mo % | S % | P % | O ppm | Al % | N ppm | Cu % | B ppm | Ti % | V % | Ac3 ° C. |
|---|---|---|---|---|---|---|---|---|---|---|---|---|---|---|---|---|---|
| Inv. | 1 | 0.107 | 0.274 | 1.484 | 0.067 | 2.107 | 0.443 | 0.008 | 0.009 | 7 | 0.022 | 115 | 0.07 | 3 | 0.009 | 0.01 | 857 |
| Inv. | 2 | 0.137 | 0.239 | 1.536 | 0.072 | 2.058 | 0.401 | 0.008 | 0.008 | 21 | 0.002 | 120 | 0.08 | 3 | 0.006 | 0.01 | 845 |
| Inv. | 3 | 0.114 | 0.235 | 0.893 | 0.059 | 1.428 | 0.406 | 0.005 | 0.007 | 10 | 0.030 | 67 | 0.06 | 31 | 0.023 | 0.01 | 874 |
| Inv. | 4 | 0.146 | 0.243 | 1.017 | 0.056 | 1.519 | 0.376 | 0.006 | 0.007 | 13 | 0.018 | 78 | 0.05 | 29 | 0.019 | 0.21 | 861 |
| Ref. | 5 | 0.160 | 0.040 | 1.240 | 0.180 | 1.380 | 0.090 | 0.031 | 0.08 | 18 | 0.020 | 148 | 0.21 | 1 | 0.002 | 0.00 | 826 |
| Ref. | 6 | 0.070 | 0.380 | 1.250 | 0.260 | 0.940 | 0.080 | 0.004 | 0.012 | 12 | 0.030 | 100 | 0.21 | 36 | 0.022 | 0.01 | 881 |
| Ref. | 7 | 0.130 | 0.260 | 1.350 | 0.050 | 1.660 | 0.100 | 0.008 | 0.008 | 9 | 0.020 | 175 | 0.05 | 25 | 0.006 | 0.01 | 848 |
| Ref. | 8 | 0.120 | 0.930 | 1.470 | 0.050 | 1.440 | 0.210 | 0.007 | 0.008 | 10 | 0.020 | 141 | 0.04 | 2 | 0.005 | 0.01 | 882 |
| Ref. | 9 | 0.120 | 0.250 | 1.110 | 0.060 | 1.920 | 0.160 | 0.006 | 0.008 | 14 | 0.020 | 155 | 0.06 | 10 | 0.006 | 0.01 | 851 |
| Ref. | 10 | 0.130 | 0.880 | 0.530 | 0.050 | 1.510 | 0.860 | 0.008 | 0.007 | 12 | 0.020 | 143 | 0.04 | 4 | 0.006 | 0.01 | 916 |

Because of the significant presence of Al at quite comparable contents, the O contents of the different samples are all comprised between 7 and 21 ppm and do not substantially have any influence on the obtained properties.

The hardenability of the different samples was evaluated by means of Jominy tests. The austenitization temperature was selected, according to the transformation point of the relevant steel, from temperatures of 875, 900 and 925° C. In order to evaluate the mechanical characteristics, parts having a square section with a size of 20 mm were taken from each of the forged bars and then treated with the following heat cycle:

heating up to the austenitization temperature;

austenitization at 930° C. for 30 minutes;

quenching in oil at 30° C.;

tempering at 190° C. for 2 hrs;

cooling in air.

This heat treatment cycle gives the possibility of estimating the expected resilience of the core of the parts treated by cementation.

Tensile and resilience specimens (of the Charpy type with a V-shaped notch) were then machined in the thereby treated parts. Table 2 shows the obtained results and they will be compared with the properties required for producing bits. The underlined data indicate the results which are not compliant with the criterion $J_1>40$, or with the hardenability criterion $\beta<3.5$ HRC, or for which the elasticity, tensile and resilience characteristics are insufficient.

TABLE 2

Mechanical properties of the tested samples

| | Samp. | T Jominy (° C.) | $J_1$ | β | Re (MPa) | Rm (MPa) | Kv 20° C. (J) |
|---|---|---|---|---|---|---|---|
| Inv. | 1 | 875 | 40.9 | 1.9 | 995 | 1280 | 121 |
| Inv. | 2 | 875 | 43.5 | 2.9 | 967 | 1291 | 108 |
| Inv. | 3 | 900 | 40.2 | 3 | 907 | 1204 | 160 |
| Inv. | 4 | 900 | 43.6 | 2 | 949 | 1212 | 89 |
| Ref. | 5 | 875 | 44.4 | 10.1 | 1016 | 1319 | 46 |
| Ref. | 6 | 900 | 35.4 | 10.7 | 746 | 850 | — |
| Ref. | 7 | 875 | 41 | 10.1 | 821 | 1106 | 123 |
| Ref. | 8 | 925 | 43 | 7.3 | 982 | 1298 | 72 |
| Ref. | 9 | 875 | 41.1 | 9.2 | 887 | 1184 | 109 |
| Ref. | 10 | 925 | 41.2 | 10.4 | 820 | 1114 | 142 |

It is noted that all the grades for which the composition is compliant with the present invention are characterized by mechanical characteristics superior to the minimum required for the production of bits, i.e. Re greater than 900 MPa, Rm greater than 1,200 MPa, Kv at 20° C. greater than 75 J, and by hardenability meeting the criteria $\beta<3.5$ HRC and $J_1>40$ HRC. Conversely, all the grades for which the composition is outside the present invention have insufficient hardenability and/or too low mechanical characteristics. This is in particular, the case of sample 6 for which the mechanical characteristics Re and Rm are in any case clearly too low for being able to use the steel for manufacturing bits, and for which measurement of the resilience was not deemed to be any use.

The capability of cementation of the steel according to the invention was also tested. Cementation tests were carried out under the following conditions. These tests were conducted on cylinders with a diameter of 25 mm and a length of 120 mm placed in industrial loads of the order of 150 to 200 kg. After cementation, the cemented cylinders were characterized in the following way:

determining according to the NF EN ISO 2639 standard, the conventional cementation depth at 550 HV and the surface hardness by micro-hardness tests under a load of 0.1 kg (a so-called « 550 HV 0.1 depth» );

determining the austenitic grain size in the layer and in the core after Bechet-Beaujard etching; this evaluation was carried out in compliance with the NF EN ISO 643 standard;

assaying, by X-ray diffractometry, the residual austenite content at 20 μm under the surface of the parts.

The cementation tests were carried out on grades No. 1 and No. 3 placed in an industrial cementation load and treated at atmospheric pressure under the following conditions:

heating at 9° C./min up to 950° C.;

maintaining constant temperature at 950° C. for 5 hrs with a carbon potential (a so-called « carbon enrichment potential» ) of 1.2%; it is recalled that a gas cementation atmosphere is characterized by its carbon potential which is the carbon content of a sample of the steel in equilibrium in the austenitic state with the cementation atmosphere, at the temperature and pressure of use;

cooling to 870° C. and maintaining this temperature for 2 hrs with a carbon potential (a so-called « carbon diffusion potential» ) comprised between 0.6 and 0.7%;

hardening with oil at 30° C.;

tempering at 190° C. for 2 hrs.

These conditions are those of a standard cementation cycle used for treating the grades 13NiCrMo13 presently used for manufacturing drill bit cones.

A cylinder in 13NiCrMo13 was therefore placed in the cementation load so as to be used as a reference and for determining the reference characteristics which have to be attained for the relevant sample format, the grades produced according to the present invention. The composition of the casting used as a reference is given in Table 3.

TABLE 3

Composition of the reference sample in 13NiCrMo13

| C (%) | Si (%) | Mn (%) | Ni (%) | Cr (%) | Mo (%) | S (%) | P (%) | O (ppm) | Al (%) | N (ppm) | Cu (%) |
|---|---|---|---|---|---|---|---|---|---|---|---|
| 0.13 | 0.23 | 0.70 | 3.24 | 1.44 | 0.11 | 0.005 | 0.01 | 11 | 0.028 | 78 | 0.19 |

The carbon potential in the diffusion phase (carbon diff. potential) was adapted to the treated grade so as to control the residual austenite surface content.

The characterization results for the reference grade are given in Table 4. Those of the two grades produced according to the present invention are given in Table 5. It is noted that the characteristics of the grades according to the present invention are identical or quasi-identical with those of the reference grade, and therefore observe in all points the minima required for manufacturing drill bits, i.e.:

cementation depth comprised between 1 and 1.5 mm;

surface hardness greater than 670 HV;

residual austenite content of less than 40%;

ASTM grain index greater than 5.

TABLE 4

Results of cementation tests (Reference)

| | Grain size | Residual austenite (%) | 550 HV0.1 depth (mm) | Surface hardness (HV0.1) | Enriched carbon potential (%) | Diffusion carbon potential (%) |
|---|---|---|---|---|---|---|
| 13NiCrMo13 (reference) | ASTM 6/7 | 36 ± 1.5 | 1.4 | 680 | 1.2 | 0.7 |

TABLE 5

Results of the cementation tests (Invention)

| | Grain size | Residual austenite (%) | 550 Hv0.1 depth (mm) | Surface hardness (HV0.1) | Enriched carbon potential (%) | Diffusion carbon potential (%) |
|---|---|---|---|---|---|---|
| Samp. 1 (Invention) | ASTM 6/8 | 39 ± 3 | 1.35 | 750 | 1.2 | 0.6 |
| Samp. 3 (Invention) | ASTM 6/7 | 36 ± 1.5 | 1.4 | 700 | 1.2 | 0.7 |

The invention claimed is:

1. A method for manufacturing a cemented steel part, wherein:

a blank of said part is prepared in a steel, and it is shaped by forging;

a cementation is carried out on said blank at atmospheric pressure, and a succession of steps during the cementation is the following:

heating up to a temperature of an enrichment level;

the enrichment level being at a temperature from 900 to 980° C. for 3 to 20 hrs and at a carbon potential comprised between 0.8 and 1.2%;

diffusion at a temperature from 820 to 880° C. at a carbon potential comprised between 0.6 and 0.8%, with a treatment period from 1 to 3 hrs;

quenching in oil at a temperature of less than or equal to 160° C.; and tempering at a temperature comprised between 150 and 250° C. and for a period comprised between 1 and 4 hrs.

* * * * *